US006380675B1

(12) United States Patent
Genz et al.

(10) Patent No.: US 6,380,675 B1
(45) Date of Patent: Apr. 30, 2002

(54) METAL HALIDE DISCHARGE LAMP WITH A LONG SERVICE LIFE

(75) Inventors: Andreas Genz; Hans-Werner Goelling, both of Berlin (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/522,914

(22) Filed: Mar. 10, 2000

(30) Foreign Application Priority Data

Mar. 26, 1999 (DE) ..... 299 05 662 U

(51) Int. Cl.[7] ..... H01J 17/20
(52) U.S. Cl. ..... 313/571; 313/637
(58) Field of Search ..... 313/490, 571, 313/576, 578, 637, 639

(56) References Cited

U.S. PATENT DOCUMENTS 5,323,085 A 6/1994 Genz ..... 313/570
5,363,007 A 11/1994 Fromm et al. ..... 313/25

FOREIGN PATENT DOCUMENTS

| | | | |
|---|---|---|---|
| EP | 0492205 | 12/1991 | ..... H01J/61/12 |
| WO | 9848446 | 4/1997 | ..... H01J/61/12 |

*Primary Examiner*—Vip Patel
(74) *Attorney, Agent, or Firm*—William H. McNeill

(57) ABSTRACT

Metal halide lamp for color applications for high wall loading with a long service life of at least 1500 hours and with a color temperature of over 5000 K: fill comprising at least the following constituents: firing gas, mercury, halogen, as well as indium, thallium, tin, no rare earth element or Na; the fill furthermore contains, as lithium replacement, hafnium, zirconium and tantalum, individually or in combination, the wall loading of the discharge vessel being at least 50 W/cm$^2$; specific output based on die arc length is 50 to 90 W/mm; in particular, the concentration of the metals is as follows: lithium replacements: 0.20–4.0 $\mu$mol/ml; indium 0.3–3.0 $\mu$mol/ml.

7 Claims, No Drawings

METAL HALIDE DISCHARGE LAMP WITH A LONG SERVICE LIFE

TECHNICAL FIELD

The invention is based on a metal halide discharge lamp with a long service life as described in the preamble of claim 1. It relates, in particular, to metal halide discharge lamps for use in effect lighting, i.e. with color temperatures of over 5000K and with medium arc lengths. The service life is at least 1500 hours.

Prior Art

WO 98/48446 has already disclosed a metal halide discharge lamp with a long service life (at least 1500 hours) which is suitable for wall loading of over 30 W/cm$^2$. For applications in effect lighting (color temperature over 5000K), the fill contains the metals Li, In, Tl and Sn. Na and rare earths are deliberately omitted, since they cause problems for the discharge vessel made from quartz glass. However, the poor wall loading is a drawback of this fill. At a high wall loading of over 50 W/cm$^2$, there is a considerable drift in the color temperature owing to diffusion of the small-atomed Li through the wall of the discharge vessel.

Furthermore, EP 492,205 has disclosed a metal halide lamp for effect lighting which, as metals, uses hafnium and/or zirconium. Otherwise, the only other additions to the fill are caesium, rare earths and cobalt or nickel. Although this lamp achieves good color reproduction (color rendering index Ra>90) and good red reproduction (R9>90), the service life is only about 500 to 750 hours.

Such lamps are preferably used for architectural and effect lighting, i.e. in particular for the strongly accentuated lighting, which stands out from the ambient lighting, of limited areas, e.g. at home, in galleries or at exhibitions. In this field, the demands imposed on the optical properties of the light, in particular on the localization of light generation, on the light flux with respect to the lamp output and on the color temperature are to be classified as lying between the field of general lighting and special demands, such as for example those imposed in the case of projection.

Despite the demands imposed on the abovementioned technical features of such lamps being higher than in the field of general illumination, considerable store is also set by a service life which is as long as possible in the effect lighting field, in order, on the one hand, to reduce the costs of replacement lamps and the work involved in changing them and, on the other hand, to increase reliability and freedom from maintenance.

Furthermore, a good color rendering and the correct color temperature are of considerable importance.

SUMMARY OF THE INVENTION

The object of the present invention is to provide a metal halide lamp according to the preamble of claim 1 which ensures good maintenance combined with a long service life (at least 1500 hours).

This object is achieved by means of the defining features of claim 1. Particularly advantageous configurations are given in the dependent claims.

It has been found that Li can be replaced by one or more of the components Hf, Zr and Ta. The content of these lithium replacements is preferably chosen to be between 0.2 and 4.0 $\mu$mol/ml.

Initially, the invention is based on the assumption that the devitrification i.e. increasing crystallization, of the bulb of a metal halide discharge lamp fundamentally determines its service life. Therefore, the invention provides a fill without rare earth elements, since these have proven to be a substantial cause of the devitrification phenomenon as the operating age of the lamp increases.

Dispensing with a rare earth element has provided the additional advantageous effect—in addition to extending the service life through reduced devitrification—of the lamp exhibiting a reduced tendency to blackening on the inner wall of the bulb.

The invention uses a fill which, in addition to the conventional constituents of firing gas, mercury, halogen, indium, thallium and tin, also contains the lithium replacements hafnium, zirconium and tantalum, individually or in combination. In this case, the lithium replacements provide the red fraction, while indium is responsible for the blue fraction and thallium is responsible for the green fraction in the radiation from the lamp. All these elements emit substantially spectral lines, while tin is used to provide a good continuum between the lines despite high wall loading. Surprisingly, this fill composition only reveals its optimum action (long service life and good maintenance combined with good light engineering parameters) above a wall loading of 50 W/cm$^2$.

Lamps with a color temperature of over 5000K, preferably over 6000K, are preferred. As explained above, the arc length of the respective lamp output is correspondingly in the middle range; in particular, the specific output based on the arc length may, depending on the particular embodiment, lie between 50 and 90 W/mm.

In order for it to be possible to set a high color temperature, it is preferable for sodium to be omitted from the lamp fill. It is particularly preferable for there to be no further constituents, apart from those mentioned, in the fill, apart from the usual impurities.

Preferred halogens are the conventionally known elements iodine and bromine, i.e. the abovementioned metals indium, thallium and tin, as well as the lithium replacements, are added to the lamp in the form of iodides and/or bromides. Furthermore, part of the mercury may be added as its iodide or bromide, in order to avoid excessive blackening of the bulb. It is therefore possible for the mercury to be added in elemental form and/or as a halide.

The following have proven advantageous concentration ranges for the four elements from the defining part of claim 1:

Lithium replacements: 0.20–4.0 $\mu$mol/ml, in particular 0.30–1.5 $\mu$mol/ml

Indium: 0.3–3.0 $\mu$mol/ml

Thallium: 0.05–0.5 $\mu$mol/ml

Tin: 0.5–5.0 $\mu$mol/ml

The abovementioned concentration ranges are advantageous not only in the overall combination but also in each case individually and independently of one another and in partial combinations.

The invention can be used to good effect in the output range from 200 to 2500 W per lamp, although it may also be employed outside these ranges. As was explained at the outset, it is suitable, in particular, for the effect lighting market, in which slightly lower demands arc imposed on the color locus and the luminous density than in specialized uses in the film or projection sectors. However, it is precisely in the field of effect lighting that the considerably improved service life constitutes a significant economic advantage.

Commercially available lamps are often provided with an additional outer bulb. In this case, instead of a vacuum between the outer bulb and the inner bulb, it is also possible to use special gas fills. The invention is equally suitable for lamps with or without an outer bulb.

The outer bulb may, for example, be advantageous to protect the inner bulb from being touched, for example if an inner bulb which is provided with two opposite sides is to be used in a lamp which is only to be connected on one side. In this case, one of the two connections of the inner bulb has to be guided along the outer wall of the inner bulb to the other side, in which case an outer bulb is provided to prevent this connection from being touched. Finally, the improved protection against explosion may be a reason for selecting a lamp with an outer bulb.

DESCRIPTION OF AN EXEMPLARY EMBODIMENT

A concrete exemplary embodiment is designed as follows:

A 300 W lamp with a discharge vessel which is closed on two sides, is made from quartz glass and contains two electrodes has a mean electrode-to-electrode distance of 5.5 mm. It is designed for operation without an outer bulb and has a bulb volume of 1.4 ml. If an outer bulb were to be used, the color temperature would be reduced slightly owing to the increase in the wall temperature. To compensate for this, the wall loading would be reduced (i.e. the lamp output reduced or the inner bulb enlarged), and/or the proportion of the halides (iodides) of the lithium replacements would be reduced, in order to obtain the desired color temperature level. In the present example, this level is 5500K. The service life is over 2000 hours.

At a firing gas pressure of 350 hPa argon, 41 mg Hg are used. The other constituents are 0.63 mg InI, 0.67 mg $SnBr_2$, 0.12 mg TlI. In addition, to achieve a wall loading over 50 $W/cm^2$ (specific output 55 W/mm), the components listed in Table 1 were added in three exemplary embodiments.

TABLE 1

| | 1st Exemplary embodiment | 2nd Exemplary embodiment | 3rd Exemplary embodiment |
|---|---|---|---|
| Color temperature in K | 6400 | 6800 | 7200 |
| Light flux in klm | 22 | 22 | 20.5 |
| Operating voltage in V | 90 | 90 | 90 |
| Lithium halide replacement | 0.72 mg $HfBr_4$ | 0.32 mg $ZrBr_4$ | 0.30 mg $TaI_5$ |
| Further halogen addition | 0.72 mg $HgBr_2$ | 0.72 mg $HgBr_2$ | None |

The physical design is conventional and corresponds, for example, to the form explained in EP-A 492,205. The corresponding disclosure is hereby incorporated by way of reference.

What is claimed is:

1. A metal halide discharge lamp with a long service life of over 1500 hours and with a color temperature of over 5000 K and with a fill comprising at least the following constituents:

a firing gas, mercury, a halogen, and indium, thallium, tin, this fill being contained in a discharge vessel and not containing any rare earth element, wherein the fill furthermore contains, as lithium replacement, hafnium, zirconium and tantalum, individually or in combination, the wall loading of the discharge vessel being at least 50 $W/cm^2$.

2. The metal halide lamp as claimed in claim 1, wherein the specific output based on the arc length is from 50 to 90 W/mm.

3. The metal halide lamp as claimed in claim 1, wherein the fill does not contain any sodium.

4. The metal halide lamp as claimed in claim 1, wherein the fill contains precisely the constituents which have been mentioned.

5. The metal halide lamp as claimed in claim 1, wherein the mercury is introduced in elemental form and/or as a halide.

6. The metal halide lamp as claimed in claim 1, wherein the color temperature is over 6000 K.

7. The metal halide lamp as claimed in claim 1, wherein the concentration of the metals is as follows:

lithium replacements: 0.20–4.0 $\mu$mol/ml indium: 0.30–3.0 $\mu$mol/ml thallium: 0.05–0.5 $\mu$mol/ml tin: 0.5–5.0 $\mu$mol/ml.

* * * * *